US012127658B2

(12) United States Patent
Kim et al.

(10) Patent No.: US 12,127,658 B2
(45) Date of Patent: Oct. 29, 2024

(54) CONTAINER

(71) Applicant: KOLMAR KOREA CO., LTD., Sejong-si (KR)

(72) Inventors: Hyung Sang Kim, Sejong-si (KR); Chang Soo Lee, Sejong-si (KR); Koo Sup Ahn, Sejong-si (KR); Jong Hyun Park, Sejong-si (KR); Hye Jin Jung, Sejong-si (KR); Hee Yoon Kim, Sejong-si (KR); Eun Ji Jeong, Sejong-si (KR)

(73) Assignee: KOLMAR KOREA CO., LTD., Sejong-si (KR)

( * ) Notice: Subject to any disclaimer, the term of this patent is extended or adjusted under 35 U.S.C. 154(b) by 5 days.

(21) Appl. No.: 17/926,960

(22) PCT Filed: May 26, 2020

(86) PCT No.: PCT/KR2020/006792
§ 371 (c)(1),
(2) Date: Nov. 21, 2022

(87) PCT Pub. No.: WO2021/235582
PCT Pub. Date: Nov. 25, 2021

(65) Prior Publication Data

US 2023/0189961 A1 Jun. 22, 2023

(30) Foreign Application Priority Data

May 20, 2020 (KR) ..... 10-2020-0060267

(51) Int. Cl.
*B65D 51/20* (2006.01)
*A45D 33/00* (2006.01)
(Continued)

(52) U.S. Cl.
CPC ..... *A45D 33/24* (2013.01); *A45D 33/003* (2013.01); *A45D 34/00* (2013.01); *A45D 40/222* (2013.01);
(Continued)

(58) Field of Classification Search
CPC ..... A45D 2040/224; A45D 2200/053; A45D 33/00; A45D 33/22; A45D 33/24;
(Continued)

(56) References Cited

U.S. PATENT DOCUMENTS 1,642,366 A * 9/1927 Goertz ..... A45D 33/006 132/298
2018/0199693 A1* 7/2018 Chung ..... A45D 33/006

FOREIGN PATENT DOCUMENTS

DE 2939664 A1 * 4/1981 ..... A45D 40/0068
JP 2009219777 A * 10/2009 ..... A45D 33/24
(Continued)

*Primary Examiner* — Anthony D Stashick
*Assistant Examiner* — Marcos Javier Rodriguez Molina
(74) *Attorney, Agent, or Firm* — Bridgeway IP Law Group, PLLC; Sang Ho Lee; Hyun Woo Shin

(57) ABSTRACT

A container is provided according to an embodiment of the present disclosure. The container may include a container part in which an accommodation space configured to accommodate contents is formed, a middle body configured to communicate with the accommodation space and coupled to the container part to surround at least a portion of the container part, an inner cover rotatably connected to the middle body to open or close the accommodation space, and an outer cover rotatably connected to the middle body to open or close the middle body.

19 Claims, 11 Drawing Sheets

(51) Int. Cl.

| | |
|---|---|
| ***A45D 33/24*** | (2006.01) |
| ***A45D 34/00*** | (2006.01) |
| ***A45D 40/22*** | (2006.01) |
| ***B65D 41/04*** | (2006.01) |
| ***B65D 43/16*** | (2006.01) |
| ***B65D 53/04*** | (2006.01) |
| *A45D 33/22* | (2006.01) |
| *A45D 33/26* | (2006.01) |
| *A45D 33/34* | (2006.01) |
| *A45D 34/04* | (2006.01) |
| *A45D 40/00* | (2006.01) |
| *A45D 40/18* | (2006.01) |
| *A45D 40/26* | (2006.01) |

(52) U.S. Cl.
CPC ..... *B65D 41/04* (2013.01); *B65D 43/16* (2013.01); *B65D 51/20* (2013.01); *B65D 53/04* (2013.01); *A45D 2040/223* (2013.01); *A45D 2200/053* (2013.01); *B65D 2251/0021* (2013.01); *B65D 2251/0053* (2013.01); *B65D 2251/0093* (2013.01); *B65D 2543/00574* (2013.01)

(58) Field of Classification Search
CPC ..... A45D 34/00; A45D 34/04; A45D 40/22; A45D 40/24; A45D 40/26; A45D 2024/002; A45D 2026/009; A45D 2033/001; A45D 2034/002; A45D 2034/005; A45D 2040/0006; A45D 2040/0025; A45D 2040/207; A45D 2040/223; A45D 2040/225; A45D 2040/226; A45D 2200/05; A45D 2200/051; A45D 2200/056; A45D 2200/058; A45D 2200/10; A45D 2200/1009; A45D 2200/1018; A45D 2200/1036; A45D 2200/207; A45D 2200/25; A45D 24/04; A45D 24/42; A45D 26/0014; A45D 33/003; A45D 33/006; A45D 33/008; A45D 33/08; A45D 33/26; A45D 33/28; A45D 33/34; A45D 33/36; A45D 34/042; A45D 34/045; A45D 34/06; A45D 40/00; A45D 40/02; A45D 40/06; A45D 40/065; A45D 40/08; A45D 40/16; A45D 40/18; A45D 40/20; A45D 40/205; A45D 40/221; A45D 40/222; A45D 40/262; A45D 40/28; A45D 44/00; A45D 44/002; A45D 44/005; A45D 44/22; B65D 1/0246; B65D 1/095; B65D 2203/12; B65D 2205/00; B65D 2251/01; B65D 2251/04; B65D 2251/1016; B65D 2251/205; B65D 2255/20; B65D 23/00; B65D 23/0885; B65D 25/02; B65D 25/08; B65D 25/10; B65D 25/101; B65D 2501/0081; B65D 2517/0052; B65D 2543/00046; B65D 2543/00055; B65D 2543/00092; B65D 2543/00222; B65D 2543/00527; B65D 2543/00537; B65D 2543/0062; B65D 2543/00703; B65D 2543/00731; B65D 2543/00814; B65D 39/12; B65D 41/02; B65D 41/04; B65D 41/0421; B65D 41/045; B65D 41/0471; B65D 41/12; B65D 41/26; B65D 41/28; B65D 41/325; B65D 41/34; B65D 41/3428; B65D 41/62; B65D 43/0231; B65D 43/16; B65D 43/22; B65D 47/00; B65D 47/0814; B65D 47/0885; B65D 47/103; B65D 47/122; B65D 47/123; B65D 47/142; B65D 47/42; B65D 50/04; B65D 50/046; B65D 51/16; B65D 51/1644; B65D 51/1688; B65D 51/18; B65D 51/24; B65D 51/242; B65D 51/245; B65D 51/28; B65D 51/32; B65D 53/00; B65D 53/02; B65D 55/02; B65D 55/022; B65D 77/24; B65D 81/05; B65D 81/07; B65D 81/18; B65D 81/2015; B65D 81/266; B65D 81/3869; B65D 83/00; B65D 85/544; B65D 88/06; B65D 88/76; B65D 90/10; B65D 90/105; B65D 90/501; B65D 90/503; B65D 90/505; B65D 90/507; B65D 1/24; B65D 1/36; B65D 19/00; B65D 2211/00; B65D 2213/00; B65D 2251/0021; B65D 2251/0053; B65D 2251/0093; B65D 25/40; B65D 2543/00018; B65D 2585/6897; B65D 2590/0083; B65D 41/0414; B65D 41/18; B65D 43/0214; B65D 43/165; B65D 14/103; B65D 51/20; B65D 51/2864; B65D 53/04; B65D 57/00; B65D 77/04; B65D 77/048; B65D 77/245; B65D 77/26; B65D 81/24; B65D 83/0805; B65D 85/1045; B65D 85/109; B65D 85/36; B65D 88/12; B65D 90/00; B65D 90/008
USPC ..... 206/11, 214, 216, 217, 232, 303, 307, 206/308.1, 310, 445, 493, 521, 524.5, 206/540, 736; 215/12.1, 211, 216, 217, 215/221, 227, 229, 251, 277, 330, 357, 215/360; 220/4.21, 86.1, 254.8, 256.1, 220/257.1, 296, 315, 505, 521, 522, 220/560.03, 567.1, 567.2, 675, 694, 220/258.3; 224/220, 604, 674
See application file for complete search history.

(56) References Cited

FOREIGN PATENT DOCUMENTS

| | | | | | |
|---|---|---|---|---|---|
| JP | 2016527972 | A | * | 9/2016 | ..... A45D 33/008 |
| JP | 2020-058953 | A | | 4/2020 | |
| KR | 10-2016-0146216 | A | | 12/2016 | |
| KR | 10-2019-0030618 | A | | 3/2019 | |
| KR | 10-2020-0022420 | A | | 3/2020 | |
| KR | 20-2020-0000645 | U | | 3/2020 | |
| WO | WO1996018553 | A1 | * | 6/1996 | ..... B65D 41/08 |
| WO | WO2018034476 | A1 | * | 2/2018 | ..... A45D 33/00 |

* cited by examiner (a)

(b)

(a)

(b)

CONTAINER

TECHNICAL FIELD

The present disclosure relates to a container, and more particularly, to a container with an improved convenience of manufacture and sealing performance.

BACKGROUND ART

Makeup is used to make one's attractive physical features stand out and furthermore, to make one's physical flaws less noticeable to make one look healthier and more attractive. Various formulations and cosmetic ingredients are used to improve the feeling of use and efficacy of cosmetic products. For example, moisture or volatile substances may be included in the contents to increase a soft and moist feeling of use or increase absorption, or active ingredients for skin, such as vitamins, may be included in the contents.

As various formulations or cosmetic ingredients are used, the airtightness and sealing performance of cosmetic containers are important. This is because, when a cosmetic container is not reliably sealed, the formulation of the contents stored in the container may change, e.g., the contents may dry and thus harden or crack, or the efficacy of the contents may decrease.

DISCLOSURE

Technical Problem

The present disclosure is directed to providing a container with an improved convenience of manufacture and sealing performance.

The technical objectives of the present disclosure are not limited to the above-mentioned objective, and other unmentioned objectives may become apparent to those of ordinary skill in the art from the following description.

Technical Solution

An embodiment of the present disclosure provides a container. The container includes a container part in which an accommodation space configured to accommodate contents is formed, a middle body configured to communicate with the accommodation space and coupled to the container part to surround at least a portion of the container part, an inner cover rotatably connected to the middle body to open or close the accommodation space, and an outer cover rotatably connected to the middle body to open or close the middle body.

The container part may include a mouth part configured to open upward and be coupled to the middle body, and an accommodation part configured to form the accommodation space below the mouth part.

The accommodation part may further include a base part configured to form a bottom surface of the accommodation space, an inner sidewall formed upward along a circumference of the base part, an outer sidewall configured to surround the inner sidewall, and a sidewall connecting part configured to connect the inner sidewall and the outer sidewall.

The outer sidewall may be made of a transparent or semitransparent material, and the inner sidewall disposed at an inner side of the outer sidewall may be visible.

The sidewall connecting part may connect the accommodation part and a lower end of the outer sidewall and may be formed to protrude downward.

A separation space between the outer sidewall and the accommodation part may open upward and may be covered by the middle body.

The inner cover may include an inner close contact part formed to protrude downward from the inner cover and configured to, when the inner cover rotates to close, come in close contact with the middle body to seal the accommodation space.

The inner cover may include a first cover locking part configured to fix the inner cover to the middle body when the inner cover rotates to close.

The middle body may include an inner edge part coupled to the container part and with which the inner cover comes in close contact when the inner cover rotates to close, an outer edge part formed at an outer side of the inner edge part and to which the outer cover is rotatably connected, and an edge connecting part configured to connect the inner edge part and the outer edge part.

The inner cover may be rotatably connected to the edge connecting part, and the outer cover may be rotatably connected to the outer edge part.

At least a portion of a first middle body locking part for the first cover locking part of the inner cover to be coupled when the inner cover rotates to close may be formed at the edge connecting part, and at least a portion of a second middle body locking part for a second cover locking part of an inner sidewall of the outer cover to be coupled when the outer cover rotates to close may be formed at the outer edge part.

The container may further include a sealing part detachably coupled to the middle body to seal the accommodation space at an inner side of the middle body, and the sealing part and the middle body may be integrally formed by a double-shot injection molding process.

The container may further include a sealing part which is detachably coupled to the middle body to seal the accommodation space at an inner side of the middle body and has a traction part formed at an upper side, and a predetermined area of a bottom surface of the inner cover may be recessed inward for at least a portion of the traction part to be accommodated therein when the inner cover rotates to close.

Advantageous Effects

According to the present disclosure, different from the related art using a double container structure made of an inner container and an outer container, a single container structure is used, and an inner cover and an outer cover are rotatably connected to a middle body so that primary sealing by the inner cover and secondary sealing by the outer cover allow contents to be effectively sealed.

Also, according to the present disclosure, a container can be implemented with a combination of three to five components, and thus manufacturing of the container is simple and economically feasible.

Also, according to the present disclosure, a container can be completed just by an operation of coupling a container part to a middle body which is integrally connected to an inner cover and an outer cover and/or connected thereto by assembly, and thus manufacturing of the container is convenient, and replacement of the container part for refill or the like is easy.

Also, according to the present disclosure, the aesthetics and functionality of a double container can be enhanced using a container part in which an outer sidewall made of a transparent material and an inner sidewall are integrally formed.

Also, according to the present disclosure, a cover locking part is provided for each of an inner cover and an outer cover and fixes a state in which the inner cover or outer cover is rotated to close with respect to the middle body, and thus further strengthened sealing performance can be provided.

Also, according to the present disclosure, an inner cover is disposed more inward of a middle body than an outer cover, and a first middle body locking part for fixing the inner cover is disposed more inward than a second middle body locking part for fixing the outer cover, and thus interference between the inner cover and the outer cover can be prevented.

In addition, according to the present disclosure, a sealing part configured to seal an accommodation space is provided inside a middle body to strengthen sealing performance, and the sealing part is made easily detachable to improve a feeling of use.

DESCRIPTION OF DRAWINGS

A brief description of each drawing will be provided for better understanding of the drawings referenced in the detailed description of the present disclosure.

MODES OF THE INVENTION

Figure 1:
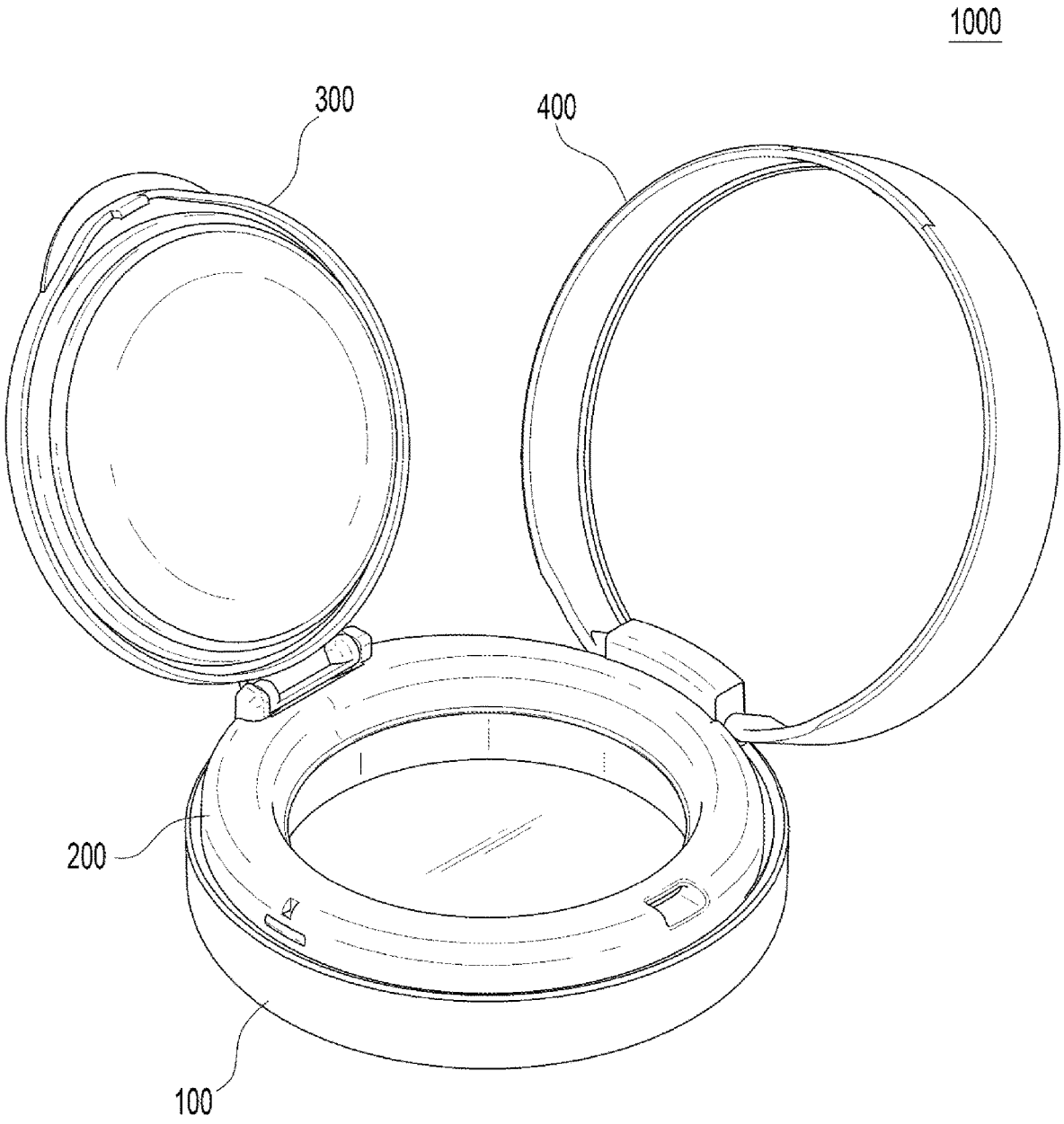
FIG. 1 illustrates a container according to an embodiment of the present disclosure.

Hereinafter, exemplary embodiments according to the present disclosure will be described in detail with reference to the accompanying drawings. The same reference numeral or symbol throughout the drawings indicates a component or element that performs substantially the same function. For the convenience of description, directions such as vertical and horizontal mentioned herein are based on the drawings, and the scope of the present disclosure is not necessarily limited by the corresponding directions.

Terms including ordinals such as first and second may be used to describe various elements, but the elements are not limited by the terms. The terms are only used for the purpose of distinguishing one element from another element. For example, without departing from the scope of the present disclosure, a first element may be referred to as a second element, and likewise, a second element may also be referred to as a first element. The term and/or includes a combination of a plurality of related items or any one item among the plurality of related items.

Terms used herein are used to describe embodiments and are not intended to limit and/or restrict the present disclosure. A singular expression includes a plural expression unless the context clearly indicates otherwise. In the specification, terms such as "include" or "have" should be understood as specifying that features, number, steps, operations, elements, components, or combinations thereof are present and not as precluding the possibility of the presence or addition of one or more other features, numbers, steps, operations, elements, components, or combinations thereof in advance.

Throughout the specification, when a certain part is described as being connected to another part, this not only includes a case in which the certain part is directly connected to the other part but also includes a case in which the certain part is electrically connected to the other part while another device is disposed therebetween. Also, when a certain part is described as including a certain element, this signifies that the certain part may further include another element rather than excluding the other element unless particularly described otherwise.

Figure 2:
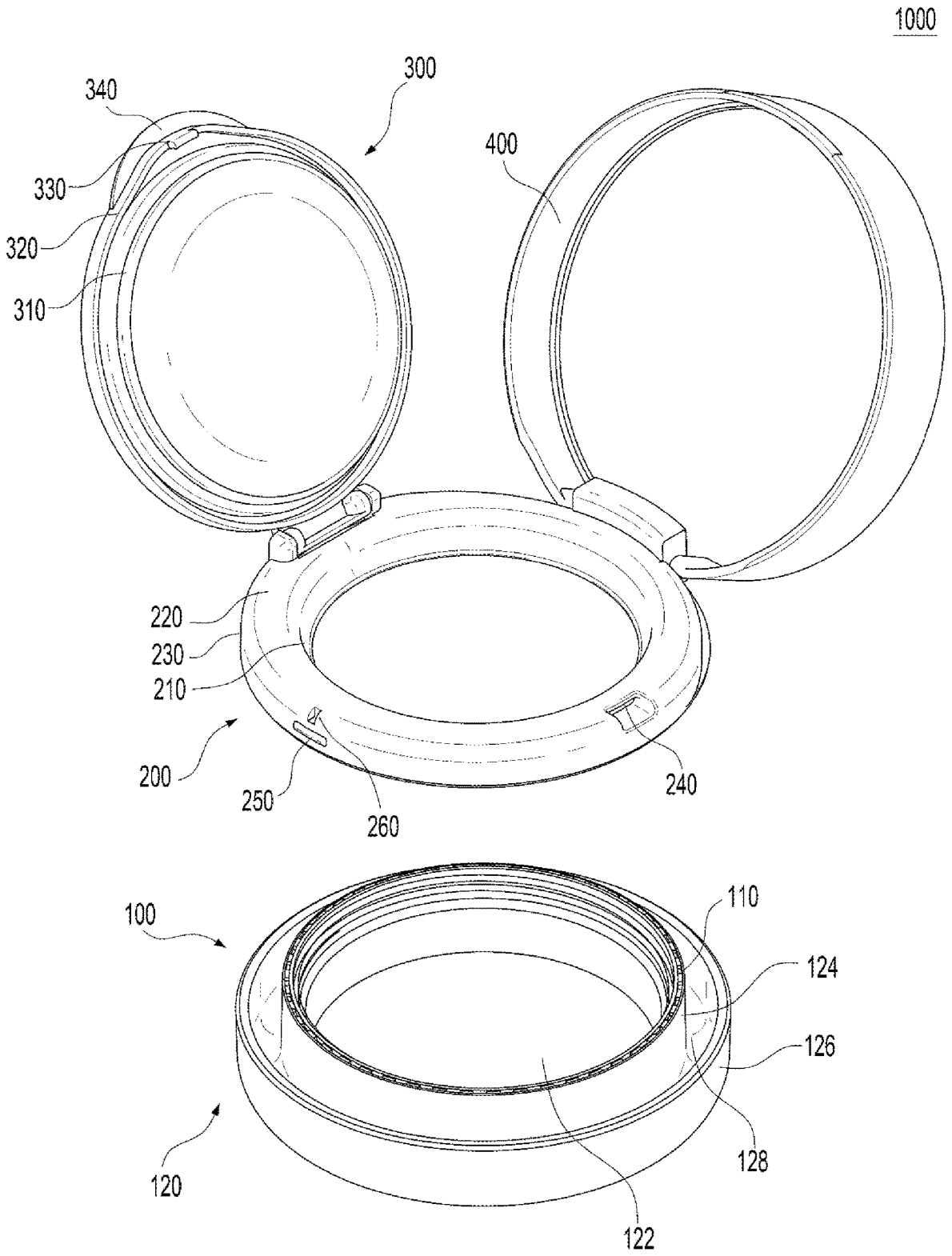
FIG. 2 illustrates an exploded state of the container according to an embodiment of the present disclosure.
Figure 3:
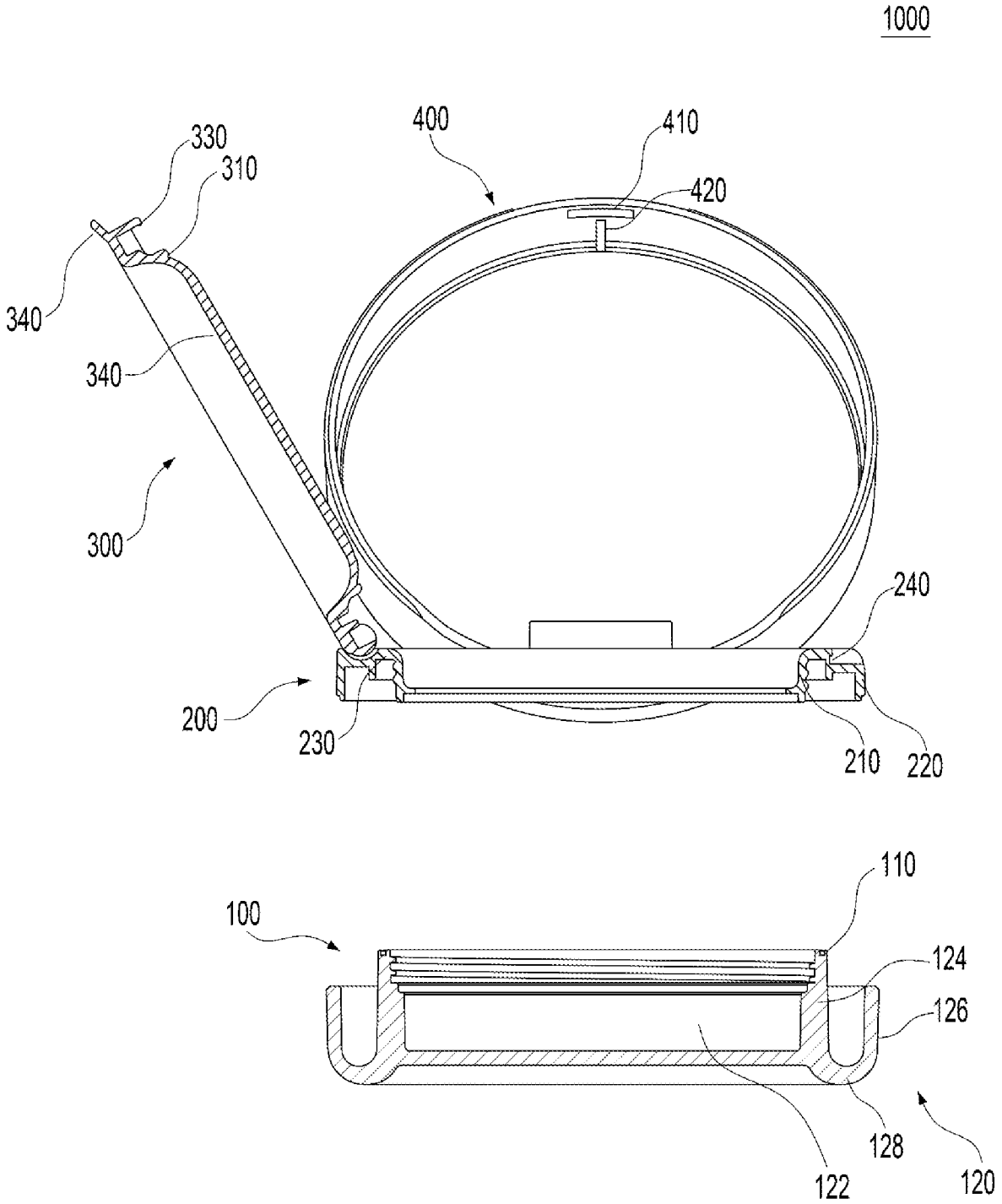
FIG. 3 illustrates a cross-section of the exploded state of the container according to an embodiment of the present disclosure.

FIG. 1 illustrates a container according to an embodiment of the present disclosure, FIG. 2 illustrates an exploded state of the container according to an embodiment of the present disclosure, and FIG. 3 illustrates a cross-section of the exploded state of the container according to an embodiment of the present disclosure.

Referring to FIGS. 1 to 3, a container 1000 may include a container part 100, a middle body 200, an inner cover 300, and an outer cover 400.

The container part 100 may have an accommodation space configured to open upward and accommodate content. Here, the content may be a cosmetic material in a liquid, gel, or powder form. Examples of the content may include a lotion, a milk lotion, a moisturizing lotion, a nourishing lotion, a skin lotion, a skin softener, a skin toner, an astringent, a massage cream, a nourishing cream, a moisturizing cream, a skin lightening essence, a tone up cream, a liquid sunscreen, sunblock, sun milk, a blemish balm (BB) cream, a base, a foundation, a color correcting (CC) cream, concealer, blusher, contour powder, an eye shadow, an eyebrow shadow, an eye cream, a primer, and the like. However, the content is not limited thereto, and other formulations or types of cosmetic materials, medical materials, or the like may be applied as the content. The accommodation space may be directly filled with the content or may be filled with the content through an impregnation member made of a sponge or the like or a makeup palette.

In an embodiment, the container part 100 may include a mouth part 110 configured to open upward and be coupled to the middle body 200 (especially to an inner edge part 210 thereof) and an accommodation part 120 formed below the mouth part 110 to form the accommodation space. Since at least a portion of the accommodation part 120 is disposed below the middle body 200, it is possible to prevent the size and/or shape of the accommodation part 120, that is, the size and/or shape of the accommodation space, from being limited by the middle body 200.

In an embodiment, screw threads may be formed on an inner side or an outer side of the mouth part 110. Screw threads may also be formed on the middle body 200 to correspond to the screw threads of the mouth part 110, and the mouth part 110 and the middle body 200 may be screw-coupled to each other. However, according to embodiments, the mouth part 110 and the middle body 200 may be coupled to each other using various methods such as fitting and hanging, other than screw-coupling, and in such cases, configurations such as a protrusion and a groove, other than screw threads, may be used in coupling.

In an embodiment, the accommodation part 120 may include a base part 122 configured to form a bottom surface of the accommodation space, an inner sidewall 124 formed upward along a circumference of the base part 122, an outer sidewall 126 configured to surround the inner sidewall 124, and a sidewall connecting part 128 configured to connect the accommodation part 120 and the outer sidewall 126. By forming a double structure made of the inner sidewall 124 and the outer sidewall 126, a volume of the container part 100 is formed, and the content can be effectively protected from external impact. In particular, a separation space (or an air layer) may be formed between the outer sidewall 126 and the inner sidewall 124 to reduce the overall weight of the container part 100 and provide improved insulation performance. Here, the accommodation part 120 is formed as one body using a single member but is not limited thereto.

In an embodiment, at least a portion of the container part 100 may be made of a transparent or semitransparent material. For example, the outer sidewall 126 may be transparent or semitransparent, and the inner sidewall 124 may be visible through the outer sidewall 126. Here, the inner sidewall 124 may be transparent, semitransparent, or opaque. However, this is only illustrative, and the container part 100 may also be made of an opaque material.

In an embodiment, the sidewall connecting part 128 may connect the inner sidewall 124 and a lower end of the outer sidewall 126. Since a lower end of the separation space between the inner sidewall 124 and the outer sidewall 126 is sealed by the sidewall connecting part 128, an introduction of foreign matter into the separation space from below the separation space can be prevented. Here, an upper end of the separation space between the inner sidewall 124 and the outer sidewall 126 is covered by the middle body 200, and thus the separation space can be prevented from contamination.

According to an embodiment, the sidewall connecting part 128 may be formed to protrude downward. While the container 1000 is mounted on an external bottom surface, due to the sidewall connecting part 128 protruding downward, the outer sidewall 126, the inner sidewall 124, and the base part 122 may be spaced apart from the external bottom surface. In this way, the container part 100 can be protected from external impact, and improved insulating performance can be provided by a separation space formed between the base part 122 and the external bottom surface.

In an embodiment, a plurality of container parts 100 may be provided. Here, the plurality of container parts 100 may have the same shape or different shapes. Thus, additionally or alternatively, the plurality of container parts 100 may accommodate the same content or different contents. That is, a user may change or replace the container parts 100 according to the user's needs or preferences or a degree of use of the contents.

In an embodiment, the accommodation space of the container part 100 may be sealed by a sealing sheet being coupled to the mouth part 110. The user may remove the sealing sheet from the container part 100 and then couple the container part 100 to the middle body 200 or the like, or may remove the sealing sheet in a state in which the container part 100 is coupled to the middle body 200 or the like, in order to use the content in the container part 100. Also, in a case in which the container part 100 is provided as a plurality of container parts 100, at least one of the container parts 100 may maintain sealed by the sealing sheet. The sealing sheet may be made of a material such as polyethylene terephthalate (PET), aluminum (Al), and polyethylene (PE).

The middle body 200 may communicate with the accommodation space and be coupled to the container part 100 to surround at least a portion of the container part 100 (for example, the mouth part 110). The inner cover and/or the outer cover may be directly or indirectly connected to the middle body 200 and may open or close the accommodation space by rotating.

In an embodiment, the middle body 200 may include the inner edge part 210 formed along a circumference of the mouth part 110 of the container part 100, an outer edge part 220 formed at an outer side of the inner edge part 210, and an edge connecting part 230 configured to connect the inner edge part 210 and the outer edge part 220. Here, the inner edge part 210, the outer edge part 220, and/or the edge connecting part 230 may be integrally formed or may be separate components that are formed to be assembled. In the latter case, the inner edge part 210, the outer edge part 220, and/or the edge connecting part 230 may be coupled to each other using various methods such as screw coupling, fitting, and hanging.

In an embodiment, the inner edge part 210 may have screw threads formed on an inner side or an outer side. The screw threads may be screw-coupled to the screw threads formed on the mouth part 110 of the container part 100. According to embodiments, the inner edge part 210 and the container part 100 may be coupled to each other using various methods such as fitting and hanging, other than screw-coupling, and in such cases, configurations such as a protrusion and a groove, other than screw threads, may be used in coupling.

In an embodiment, when the middle body 200 and the container part 100 are coupled to each other, the outer edge part 220 may come in close contact with an upper end surface and/or an inner side surface of the outer sidewall 126 of the container part 100. The separation space between the outer sidewall 126 and the inner sidewall 124 may be covered by the outer edge part.

In an embodiment, the inner cover 300 and the outer cover 400 may rotate with respect to the middle body 200 in order to open or close the accommodation space. Specifically, the inner cover 300 may rotate to open with respect to the middle body 200 and open the accommodation space, and the inner cover 300 may rotate to close with respect to the middle body 200 and come in close contact with the inner edge part 210 of the middle body 200 to seal the accommodation space. In addition, the outer cover 400 may rotate to open with respect to the middle body 200 and open the accommodation space, and the outer cover 400 may rotate to close with respect to the middle body 200 and come in close contact with the edge connecting part 230 or the outer edge part 220 of the middle body 200 to seal the accommodation space.

Here, in order to prevent interference between the inner cover 300 and the outer cover 400, the inner cover 300 may be connected to be rotatable more inward of the middle body 200 than the outer cover 400. For example, the inner cover 300 may be rotatably connected to the edge connecting part 230, and the outer cover 400 may be rotatably connected to the outer edge part 220. Also, for example, the inner cover 300 may be rotatably connected to the inner edge part 210, and the outer cover 400 may be rotatably connected to the edge connecting part 230 and/or the outer edge part 220.

In an embodiment, a first middle body locking part 240 and a second middle body locking part 250 may be formed at the middle body 200. The first middle body locking part 240 and the second middle body locking part 250 may be respectively coupled to a first cover locking part 330 of the inner cover 300 and a second cover locking part 410 of the outer cover 400 and fix states in which the inner cover 300 and the outer cover 400 are rotated to close.

Here, in order to prevent interference between the inner cover 300 and the outer cover 400, the first middle body locking part 240 may be formed more inward of the middle body 200 than the second middle body locking part 250. For example, at least a portion of the first middle body locking part 240 may be formed at the edge connecting part 230, and at least a portion of the second middle body locking part 250 may be formed at the outer edge part 220. For example, at least a portion of the first middle body locking part 240 may be formed at the edge connecting part 230 and/or the outer edge part 220, and at least a portion of the second middle body locking part 250 may be formed at the outer edge part 220 and/or the edge connecting part 230. For example, at least a portion of the first middle body locking part 240 may be formed at the inner edge part 210, and at least a portion of the second middle body locking part 250 may be formed at the edge connecting part 230 and/or the outer edge part 220. Even when at least a portion of the first middle body locking part 240 and at least a portion of the second middle body locking part 250 are both formed at the outer edge part 220, the edge connecting part 230, or the like, at least a portion of the second middle body locking part 250 may be formed more outward of the middle body 200 than at least a portion of the first middle body locking part 240.

The inner cover 300 may be rotatably connected to the middle body 200 and may rotate to open or rotate to close with respect to the middle body 200 and open or close the accommodation space.

In an embodiment, the inner cover 300 may be integrally formed with at least a portion of the middle body 200 or may be formed as a separate component and connected to the middle body 200 by assembly connection. In the former case, for example, the inner cover 300 may be connected to the middle body 200 through a soft bent part integrally formed between the inner cover 300 and the middle body 200, and due to curvature of the bent part, the inner cover 300 may rotate with respect to the edge part. In the latter case, for example, the inner cover 300 may be rotatably connected to the middle body 200 by coupling between a rotation protrusion and a rotation groove formed at the inner cover 300 and the middle body 200, respectively. Also, for example, through-holes that correspond to each other may be formed in the inner cover 300 and the middle body 200, a fixing pin may be inserted into the through-holes, and the inner cover 300 and the edge part may be rotatably connected.

In an embodiment, an inner close contact part 310 may be formed to protrude downward from the inner cover 300. When the inner cover 300 rotates to close, the inner close contact part 310 may come in close contact with the middle body 200, especially the inner edge part 210, and further strengthen the sealing of the accommodation space.

In an embodiment, an outer close contact part 320 may be formed to protrude downward from the inner cover 300. The outer close contact part 320 may be formed along a circumference at an outer side of the inner close contact part 310, and when the inner cover 300 rotates to close, the outer close contact part 320 may come in close contact with the middle body 200 (especially, the edge connecting part 230) and further strengthen sealing of the accommodation space.

In an embodiment, the first cover locking part 330 configured to fix the inner cover 300 to the middle body 200 (especially, the first middle body locking part 240) when the inner cover 300 rotates to close may be formed at the inner cover 300. The first cover locking part 330 may be formed to protrude from a part of the outer close contact part 320 or may be formed between the outer close contact part 320 and the inner close contact part 310. For example, the first cover locking part 330 may include a catching protrusion, and corresponding thereto, the first middle body locking part 240 may include a catching groove. In particular, since the catching groove of the first middle body locking part 240 is formed due to the edge connecting part 230 being recessed, and the catching protrusion of the first cover locking part 330 is coupled by being inserted into the catching groove, while the inner cover 300 is fixed to the middle body 200, movement of the inner cover 300 due to an external force in the lateral direction can be prevented. However, such coupling is only illustrative, and positions of the catching protrusion and the catching groove in the first cover locking part 330 and the first middle body locking part 240 may be changed, or the first cover locking part 330 and/or the first middle body locking part 240 may be formed with a combination of a catching protrusion and a catching groove. Also, according to embodiments, the first middle body locking part 240 and the first cover locking part 330 may be coupled using various other methods such as fitting and hanging.

In an embodiment, a grip part 340 may be formed to protrude from the inner cover 300 in a lateral direction. The user may rotate the inner cover 300 using the grip part 340 to open or close the accommodation space.

In an embodiment, an applicator accommodation groove 350 may be formed in an upper side of the inner cover 300. The applicator accommodation groove 350 may be formed by an upper surface of the inner cover 300 being recessed downward, and an applicator (e.g., a puff, a brush, or the like) may be accommodated therein. Additionally or alternatively, a second content may be accommodated in at least a portion of the applicator accommodation groove 350. The second content may be the same as or different from the content accommodated in the accommodation space of the container part 100. Additionally or alternatively, the applicator accommodation groove 350 may be configured to be divided into at least two or more areas. Either a plurality of applicators which are the same as or different from each other or a plurality of second contents which are the same as or different from each other may be accommodated in the areas divided from each other.

The outer cover 400 may be rotatably connected to the middle body 200 and may rotate to open or rotate to close with respect to the middle body 200 and open or close the middle body 200. The accommodation space of the container part 100 may be primarily sealed by the inner cover 300 and may be secondarily sealed by the outer cover 400.

In an embodiment, the outer cover 400 may be integrally formed with at least a portion of the middle body 200 or may be formed as a separate component. In the former case, the outer cover 400 may be connected to the middle body 200 (for example, the outer edge part 220 or the like) through a soft bent part integrally formed therewith, and due to curvature of the bent part, the outer cover 400 may rotate with respect to the middle body 200. In the latter case, for example, the outer cover 400 may be rotatably connected to the middle body 200 by coupling between a rotation protrusion and a rotation groove formed at the outer cover 400 and the middle body 200, respectively. Also, for example, through-holes that correspond to each other may be formed in the outer cover 400 and the middle body 200, a fixing pin may be inserted into the through-holes, and the outer cover 400 and the middle body 200 may be rotatably connected.

In an embodiment, when the outer cover 400 rotates to close, an inner sidewall of the outer cover 400 may come in close contact with the middle body 200, especially, the outer edge part 220. Additionally or alternatively, a lower end of the outer cover 400 may come in close contact with an upper end of the accommodation part 120 (especially, the outer sidewall 126).

In an embodiment, the second cover locking part 410 configured to fix the outer cover 400 to the middle body 200 (especially, the second middle body locking part 250) when outer cover 400 rotates to close may be formed at the outer cover 400. The second cover locking part 410 may be formed in one area of an inner sidewall of the outer cover 400. For example, the second cover locking part 410 may include a catching protrusion, and corresponding thereto, the second middle body locking part 250 may include a catching protrusion. However, such coupling is only illustrative, and a catching groove may be formed in one of the second cover locking part 410 and the second middle body locking part 250, or the second cover locking part 410 and/or the second middle body locking part 250 may be formed with a combination of a catching protrusion and a catching groove. Also, according to embodiments, the second middle body locking part 250 and the second cover locking part 410 may be coupled using various other methods, such as fitting and hanging.

In an embodiment, a fixing protrusion 420 may be formed on the outer cover 400, and corresponding thereto, a fixing groove 260 may be formed in the edge connecting part 230 of the middle body 200. While the outer cover 400 is fixed to the middle body 200, by the fixing protrusion 420 being inserted into the fixing groove 260, movement of the outer cover 400 due to an external force in the lateral direction can be prevented.

In an embodiment, a mirror may be disposed on an inner side surface of the outer cover 400.

In an embodiment, the container 1000 may further include an impregnation member. The impregnation member may be disposed in the accommodation space of the container part 100 and impregnated with content. To this end, for example, the impregnation member may be made of a porous material or the like, an impregnation space formed in the impregnation member may be impregnated with content, and the impregnated content may be discharged when an external force is applied.

In an embodiment, the impregnation member may include a sponge, nonwoven fabric, cloth, or a combination thereof. Here, for example, the sponge may be made of one or more materials selected from the group consisting of foam, natural rubber, synthetic resin, polyurethane, latex, acrylonitrile-butadiene rubber (NBR), butadiene rubber (BR), styrene-butadiene rubber (SBR), chloroprene rubber (CR), butyl rubber (isobutylene-isoprene rubber (IIR)), isoprene rubber (IR), vulcanized ethylene-propylene rubber (EPR), polysulfide rubber, silicone rubber, fluoro rubber, urethane rubber, acrylic rubber, ethylene propylene diene monomer (EPDM) rubber, polyvinyl alcohol (PVA), ethylene vinyl acetate, nitrile rubber, and mixtures thereof, but the sponge is not limited thereto. Also, for example, nonwoven fabric and/or cloth may be manufactured by adhering and/or weaving natural fiber, artificial fiber, or a combination thereof. Examples of natural fiber may include cotton, kapok cotton, coir, manila hemp, sisal hemp, flax, ramie, *cannabis*, kenaf, abaca, kapok, china grass, jute, hemp, wool, goat hair, cashmere, camel hair, alpaca hair, wool fiber, cultivated silk, wild silk, asbestos, and a cellulosic fiber, and examples of artificial fiber may include polynosic rayon, viscose rayon, cupra rayon, acetate, triacetate, polyester-based fiber, polyurethane-based fiber, polyethylene-based fiber, polyvinyl chloride-based fiber, polyvinylidene-based fiber, polytetrafluoroethylene-based fiber, polyolefin-based fiber, polyamide-based fiber, casein fiber, alginic acid fiber, cellulose-based fiber, rubber fiber, SBR, and NR. However, natural fiber and artificial fiber are not limited thereto. Also, the impregnation member may be formed with a single layer or a combination of a plurality of layers, and in a case in which a plurality of layers are combined, each layer may be made of the same material or different materials.

In an embodiment, a cover part may be coupled to the impregnation member. The cover part is for covering a bottom surface of the impregnation member and can prevent contamination of and damage to the impregnation member during transportation or storage of the impregnation member. Here, the cover part may be made of a soft waterproof material and may be deformed to some extent according to the deformation of the impregnation member, thus preventing the content impregnated in the impregnation member from leaking to the outside. In particular, since leakage of the content is blocked by the cover part even when the container part is made of a transparent or semitransparent material, leaking content can be prevented from being exposed to the outside. For example, the cover part may be made of oriented polypropylene, polypropylene, polyethylene, low-density polyethylene (LDPE), high-density polyethylene (HDPE), polyurethane, polyethylene terephthalate, nylon, or a combination thereof, but the cover part is not limited thereto.

In an embodiment, a plurality of impregnation members may be provided. Here, the materials or shapes of the impregnation members may be the same as or different from each other. Also, each impregnation member may be impregnated with the same content or different contents. The user may change the impregnation member according to the user's needs or preferences. A plurality of container parts 100 configured to accommodate the plurality of impregnation members may be provided, or a plurality of impregnation members may be accommodated in a separate packaging container (or a pouch).

Figure 4:
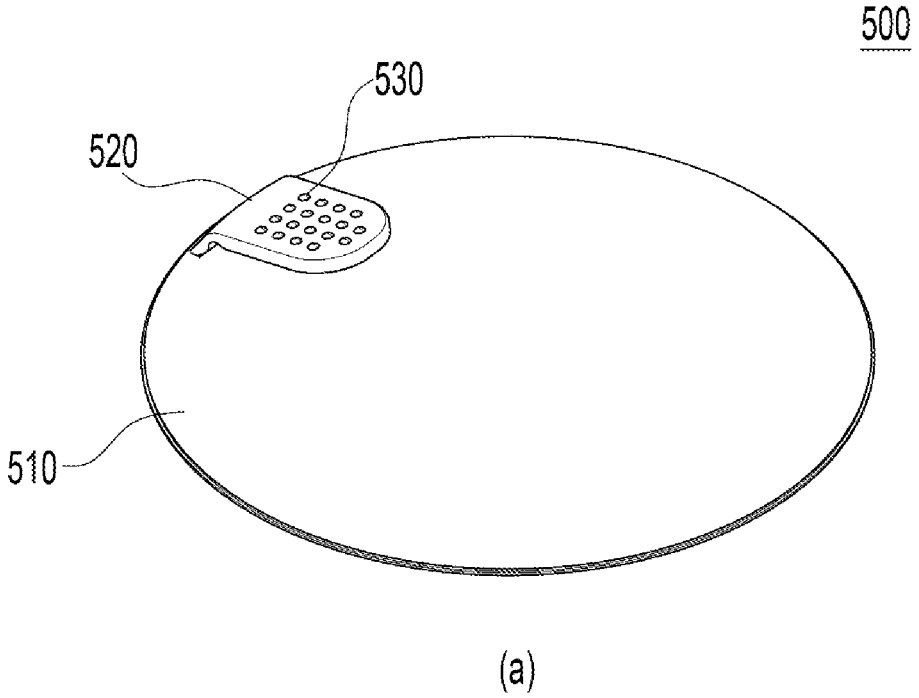
FIG. 4 illustrates a sealing part according to an embodiment of the present disclosure.
Figure 4:
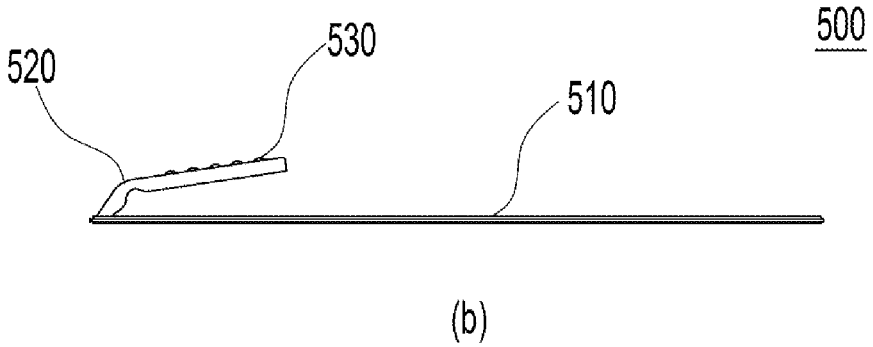
Figure 5:
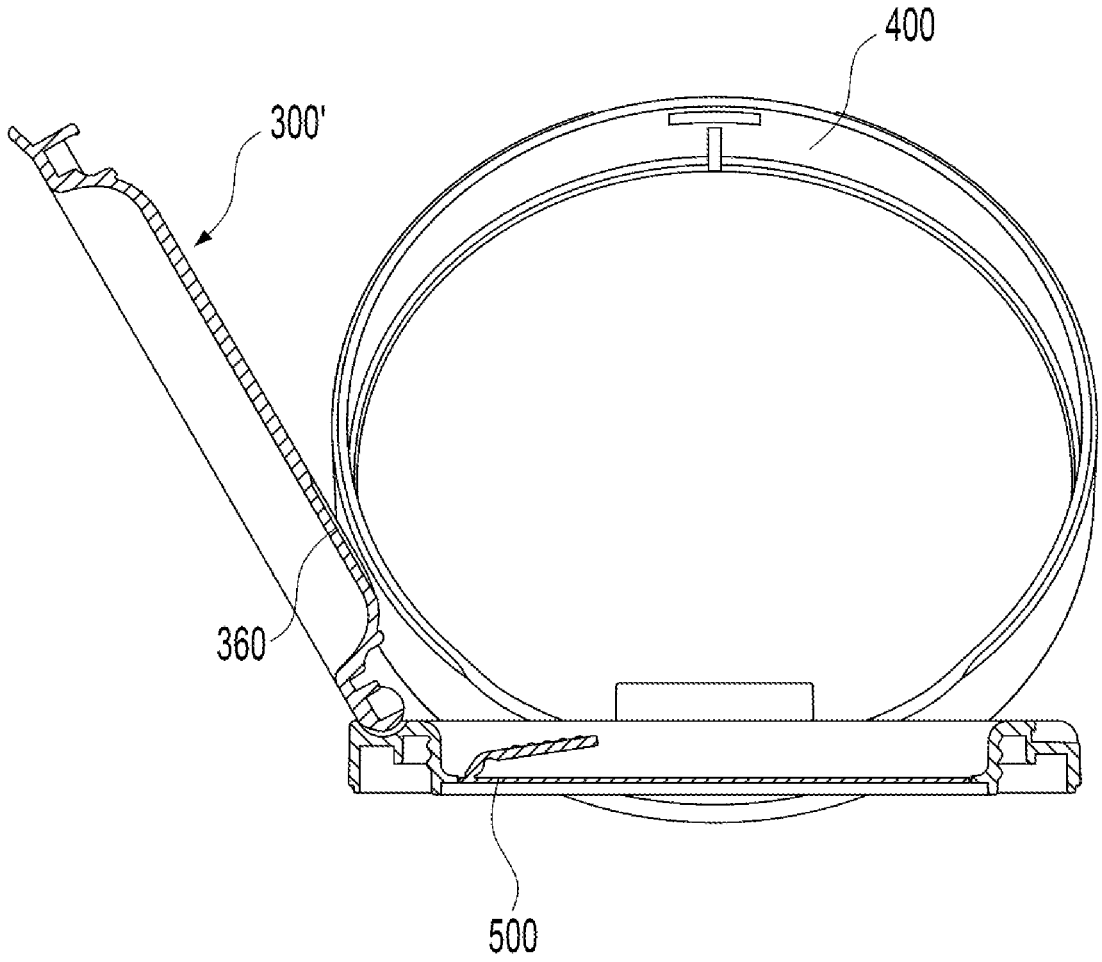
FIGS. 5 and 6 illustrate a container including the sealing part according to an embodiment of the present disclosure.
Figure 6:
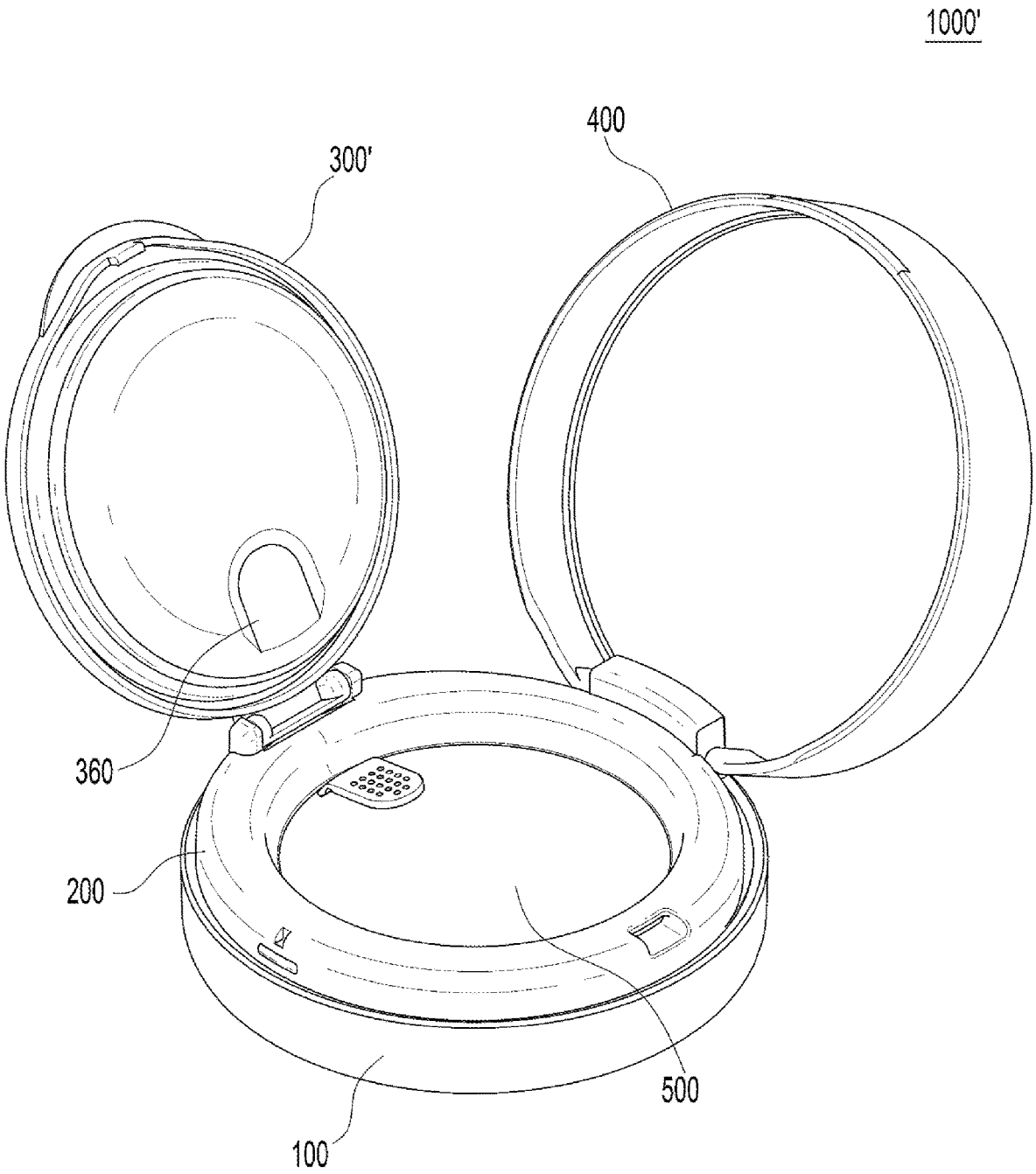

FIG. 4 illustrates a sealing part according to an embodiment of the present disclosure, and FIGS. 5 and 6 illustrate a container including the sealing part according to an embodiment of the present disclosure.

Referring to FIGS. 4 to 6, a container 1000' may include a sealing part 500 disposed at an inner side of the middle body 200 to seal the accommodation space. The sealing part 500 may be detachably coupled to the middle body 200 (especially, to the inner edge part 210). That is, the sealing part 500 may be coupled to the middle body 200 and seal the accommodation space and then may be separated from the middle body 200 and open the accommodation space.

In an embodiment, the sealing part 500 may include a sealing plate 510 having a shape that corresponds to the accommodation space and a traction part 520 formed at an upper side of the sealing plate 510. Specifically, the sealing plate 510 may be coupled to the inner edge part 210 of the middle body 200 and keep the accommodation space sealed and then may be easily separated by the user and open the accommodation space. Here, the user may easily separate the sealing part 500 through an operation of holding and pulling the traction part 520. In order to facilitate gripping and pulling out, the traction part 520 may be formed to extend from the sealing plate 510 and have a predetermined slope. For example, the slope may be in a range of 200 to 600 or 200 to 400 but is not limited thereto.

In an embodiment, in order to provide a sufficient space for finger insertion below the traction part 520, the traction part 520 may include at least one bent part. Also, the at least one bent part may allow the traction part 520 to have a predetermined angle with respect to the sealing plate 510, and in a case in which the traction part 520 is pressed downward when the inner cover 300 rotates to close, the traction part 520 may be bent in a distributed manner with respect to the at least one bent part.

In an embodiment, a predetermined friction protrusion 530 may be formed on one surface of the traction part 520.

In an embodiment, the traction part 520 may be formed on one area of an edge of the sealing plate 510 and allow the sealing plate 510 to be separated in an opposite direction from the corresponding area when the traction part 520 is pulled out.

In an embodiment, a traction part accommodation groove 360 may be formed by a predetermined area of a bottom surface of the inner cover 300 being recessed inward. At least a portion of the traction part 520 may be accommodated in the traction part accommodation groove 360 when the inner cover 300 rotates to close. In this way, the sealing part 500 formed at an upper side and having a predetermined slope can be prevented from being deformed or damaged due to being excessively pressed by the inner cover 300.

In an embodiment, at least a portion of the sealing part 500 may be made of a soft material. During the removal of the sealing part 500, the sealing part 500 may be naturally bent and separated from the middle body 200.

In an embodiment, in order to facilitate coupling and separation between the sealing part 500 and the middle body 200, the sealing part 500 and the middle body 200 may be integrally formed by double-shot injection molding. For example, the middle body 200 may be molded, and the sealing part 500 may be molded with respect to the middle body 200. Here, the sealing part 500 and the middle body 200 may be made of different materials. For example, the middle body 200 may be made of a hard material, and the sealing part 500 may be made of a soft material. In this way, while the middle body 200 and the sealing part 500 are integrally formed to effectively seal the accommodation space, the sealing part 500 may be easily separated from the middle body 200. However, this is only illustrative, and the middle body 200 and the sealing part 500 may be implemented using various other methods such as an assembly process (fitting, screw-coupling, and the like), an adhesion process by an adhesive material, an external-heat bonding process in which heat is applied from the outside (through a heating or pressing member), and an internal-heat bonding process in which heat is generated from the inside (through ultrasonic waves, low-frequency waves, and the like).

Figure 7:
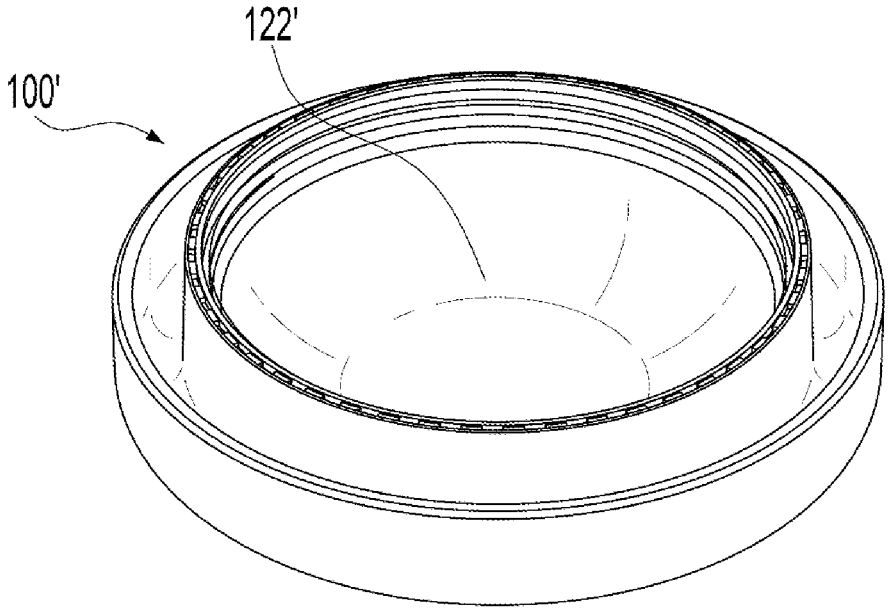
FIG. 7 illustrates a container part according to an embodiment of the present disclosure.
Figure 7:
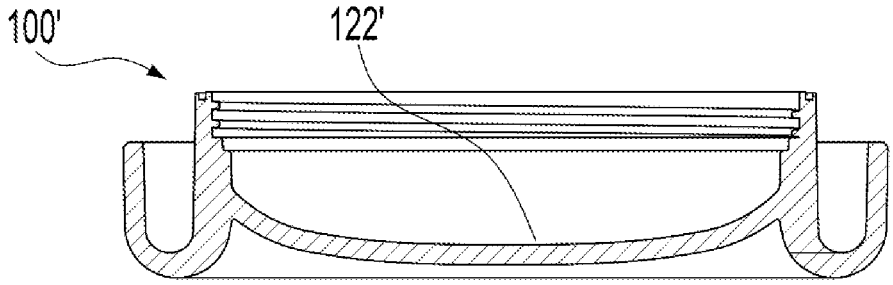

FIG. 7 illustrates a container part according to an embodiment of the present disclosure.

Referring to FIG. 7, a container part 100' may have a shape in which a base part 122' is convex downward. In this way, content in the accommodation space may naturally move to the center of the accommodation space, making it easy for the user to use the content. In particular, even when the content is impregnated in the impregnation member, the content may move to the center along the base part 122'.

Also, since the sidewall connecting part 128 is formed to be convex downward and protrudes more than the base part 122' in the container part 100', even when the base part 122' has a shape that is convex downward, the container part 100' can be stably supported on the external bottom surface.

The shape of the container part 100' illustrated in FIG. 7 is only illustrative, and various other configurations may be applied according to embodiments to which the present disclosure is applied.

Figure 8:
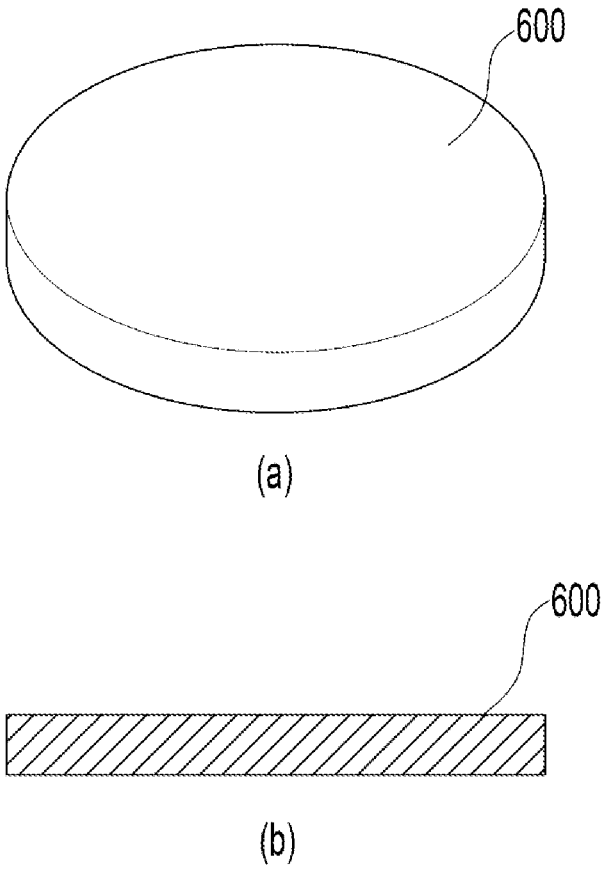
FIGS. 8 and 9 illustrate an impregnation member according to an embodiment of the present disclosure.
Figure 9:
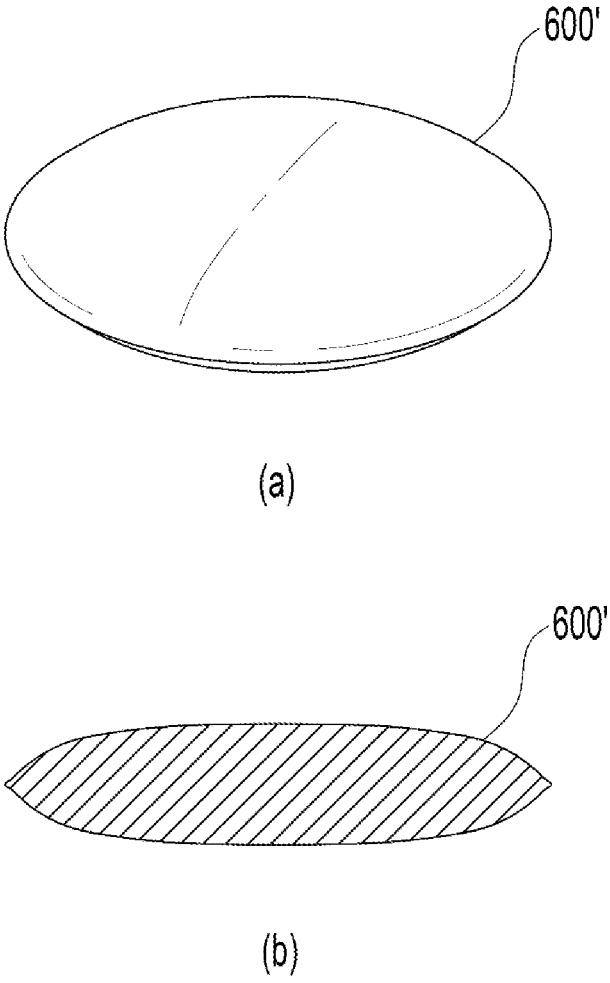

FIGS. 8 and 9 illustrate an impregnation member according to an embodiment of the present disclosure.

Referring to FIGS. 8 and 9, impregnation members 600 and 600' may have various shapes. As illustrated in FIG. 8, the impregnation member 600 may have a flat plate shape, or as illustrated in FIG. 9, the impregnation member 600' may have a vertically convex shape. In the case of the impregnation member 600', for example, the impregnation member 600' may include a plurality of layers, and edges of the layers may be bonded to each other. By such edge bonding, the plurality of layers may be coupled and form the impregnation member 600' that is vertically convex. Here, the edge bonding may be implemented using various other methods such as an adhesion process by an adhesive material, an external-heat bonding process in which heat is applied from the outside (through a heating or pressing member), and an internal-heat bonding process in which heat is generated from the inside (through ultrasonic waves, low-frequency waves, and the like).

For the impregnation members 600 and 600' to be stably disposed, the container parts 100 and 100' may have shapes that at least partially correspond to the impregnation members 600 and 600'. Specifically, the container part 100 may have the base part 122, which is flat, and accommodate the impregnation member 600, and the container part 100' may have the base part 122', which is convex downward, and accommodate the impregnation member 600'.

The shapes of the impregnation members 600 and 600' illustrated in FIGS. 8 and 9 are only illustrative, and various other configurations may be applied according to embodiments to which the present disclosure is applied.

Figure 10:
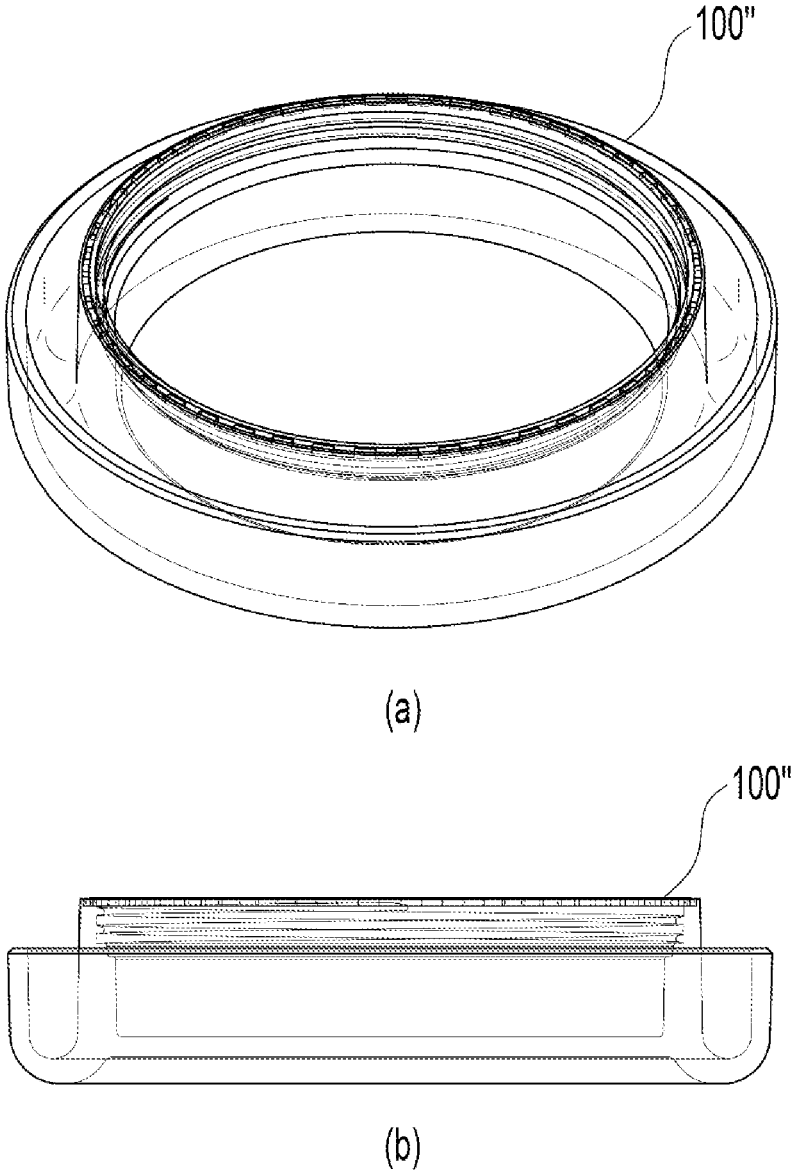
FIGS. 10 and 11 illustrate container parts according to embodiments of the present disclosure.
Figure 11:
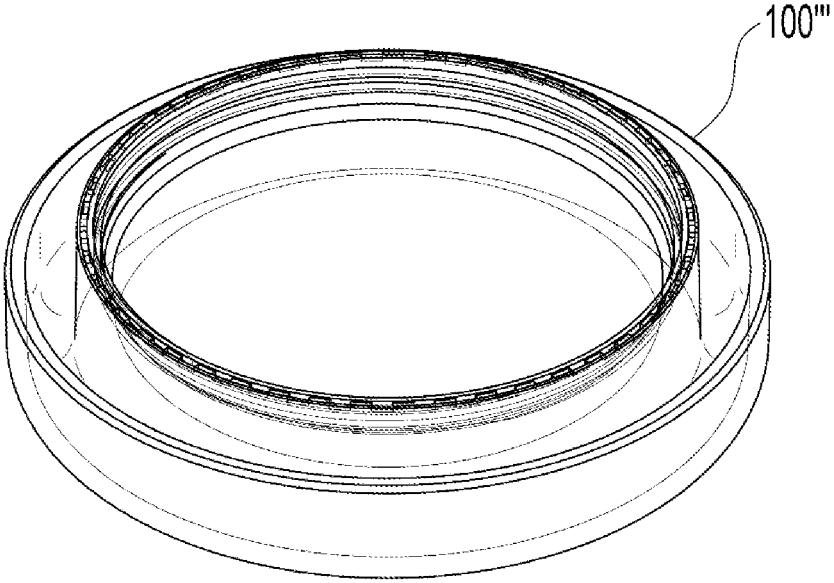
Figure 11:
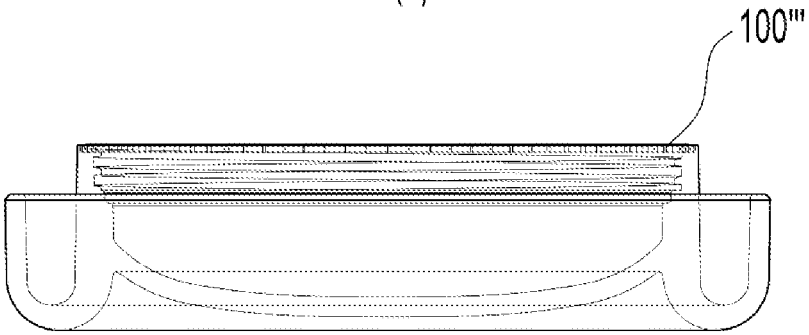

FIGS. 10 and 11 illustrate container parts according to embodiments of the present disclosure.

Referring to FIGS. 10 and 11, container parts 100" and 100'" may be made of a transparent material. Therefore, the inner sidewall may be visible through the transparent outer sidewall, and contents within the inner sidewall may also be visible. In particular, even when the container parts 100" and 100'" are made of a single material, the same effect as when the container parts 100" and 100'" have a double container structure through repeated sidewalls can be achieved.

Only some embodiments have been described above with reference to the accompanying drawings, and those of ordinary skill in the art may make various modifications and changes to the above. For example, appropriate results may be achieved even when the techniques described above are performed in a different order from the methods described above, and/or the components are coupled or combined in a different form from the methods described above or substituted with other components or their equivalents. Also, the embodiments may be carried out in combination as necessary. Therefore, other implementations, other embodiments, and those equivalent to the claims below also belong to the scope of the claims.

The invention claimed is:

1. A container comprising:

a container part in which an accommodation space configured to accommodate contents is defined;

a middle body configured to communicate with the accommodation space and coupled to the container part surrounding at least a portion of the container part;

an inner cover rotatably connected to the middle body to open or close the accommodation space; and an outer cover rotatably connected to the middle body to open or close both the inner cover and the middle body, wherein when the outer cover is closed, both the middle body and inner cover are completely sealed and positioned between the outer cover and the container part.

2. The container of claim 1, wherein the container part comprises:

a mouth part configured to open in a first direction and be coupled to the middle body, and an accommodation part defining the accommodation space disposed on the mouth part.

3. The container of claim 2, wherein the accommodation part further comprises a base part configured to define a bottom surface of the accommodation space, an inner sidewall extended in the first direction along a circumference of the base part, an outer sidewall configured to surround the inner sidewall, and a sidewall connecting part configured to connect the inner sidewall and the outer sidewall.

4. The container of claim 3, wherein the outer sidewall is made of a transparent or semitransparent material, and the inner sidewall disposed at an inner side of the outer sidewall is visible from outside.

5. The container of claim 3, wherein the sidewall connecting part connects the accommodation part and a lower end of the outer sidewall and protrudes in a second direction.

6. The container of claim 3, wherein a separation space between the outer sidewall and the accommodation part is defined to open in the first direction and is covered by the middle body.

7. The container of claim 1, wherein the inner cover includes an inner close contact part protruding in a second direction from the inner cover and configured to, when the inner cover rotates to close, come in close contact with the middle body to seal the accommodation space.

8. The container of claim 1, wherein the inner cover includes a first cover locking part configured to fix the inner cover to the middle body when the inner cover rotates to close.

9. The container of claim 1, wherein the middle body includes an inner edge part coupled to the container part and with which the inner cover comes in close contact when the inner cover rotates to close, an outer edge part defined at an outer side of the inner edge part and to which the outer cover is rotatably connected, and an edge connecting part configured to connect the inner edge part and the outer edge part.

10. The container of claim 9, wherein the inner cover is rotatably connected to the edge connecting part, and the outer cover is rotatably connected to the outer edge part.

11. The container of claim 9, wherein at least a portion of a first middle body locking part for a first cover locking part of the inner cover to be coupled when the inner cover rotates to close is disposed at the edge connecting part, and at least a portion of a second middle body locking part for a second cover locking part of an inner sidewall of the outer cover to be coupled when the outer cover rotates to close is disposed at the outer edge part.

12. The container of claim 7, further comprising a sealing part detachably coupled to the middle body to seal the accommodation space at an inner side of the middle body, wherein the sealing part and the middle body are integrally formed.

13. The container of claim 12, further comprising the sealing part which is detachably coupled to the middle body to seal the accommodation space at the inner side of the middle body and has a traction part formed at an upper side, wherein a predetermined area of a bottom surface of the inner cover is recessed inward for at least a portion of the traction part to be accommodated therein when the inner cover rotates to close.

14. The container of claim 5, wherein the first direction and the second direction are different directions.

15. The container of claim 14, wherein the first direction is in an opposite direction from the second direction.

16. The container of claim 3, wherein when the outer cover is closed, a lower end of the outer cover is configured to come in close contact with the outer sidewall.

17. The container of claim 1, wherein when the accommodation space is sealed by the inner cover, the outer cover is configured to cover the accommodation space.

18. The container of claim 1, wherein the middle body and the container are detachably attached from one another.

19. The container of claim 1, wherein the middle body includes an inner edge part coupled to the container part and with which the inner cover comes in close contact when the inner cover rotates to close, an outer edge part defined at an outer side of the inner edge part and to which the outer cover is rotatably connected, and an edge connecting part configured to connect the inner edge part and the outer edge part, wherein the container part comprises: a mouth part configured to open in a first direction and be coupled to the middle body, and an accommodation part defining the accommodation space disposed on the mouth part, wherein the accommodation part further comprises a base part configured to define a bottom surface of the accommodation space, an inner sidewall extended in the first direction along a circumference of the base part, an outer sidewall configured to surround the inner sidewall, and a sidewall connecting part configured to connect the inner sidewall and the outer sidewall, and wherein the middle body and the container are detachably attached from one another, and wherein the outer edge part is in close contact with an inner side surface of the outer sidewall.

* * * * *